US010418019B1

(12) United States Patent
Murad et al.

(10) Patent No.: US 10,418,019 B1
(45) Date of Patent: Sep. 17, 2019

(54) METHOD AND SYSTEM TO MASK OCCUPANT SOUNDS IN A RIDE SHARING ENVIRONMENT

(71) Applicant: GM GLOBAL TECHNOLOGY OPERATIONS LLC, Detroit, MI (US)

(72) Inventors: Mohannad Murad, Troy, MI (US); Joseph G. Machak, Oakland Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/362,083

(22) Filed: Mar. 22, 2019

(51) Int. Cl.
*H04R 3/02* (2006.01)
*G10K 11/175* (2006.01)

(52) U.S. Cl.
CPC ..... *G10K 11/175* (2013.01); *G10K 2210/128* (2013.01)

(58) Field of Classification Search
CPC ..... G10K 11/175
See application file for complete search history.

(56) References Cited

U.S. PATENT DOCUMENTS

| | | | | |
|---|---|---|---|---|
| 9,286,880 | B2 | 3/2016 | Koga et al. | |
| 10,319,360 | B1 * | 6/2019 | He | G10K 11/175 |
| 2004/0158460 | A1 * | 8/2004 | Finn | G10L 21/0208 704/205 |
| 2005/0013451 | A1 * | 1/2005 | Finn | H04R 3/02 381/110 |
| 2007/0055513 | A1 | 3/2007 | Hwang et al. | |
| 2013/0163772 | A1 | 6/2013 | Kobayashi et al. | |
| 2018/0190282 | A1 * | 7/2018 | Mohammad | G10K 11/178 |

* cited by examiner

*Primary Examiner* — Simon King

(57) ABSTRACT

One general aspect includes a method of sound masking, the method including: receiving, via a processor, a privacy request from a user; generating, via the processor, a masking sound configured to mask speech of the user in response to the privacy request; and providing, via the processor, the masking sound as an audio output through an audio system.

14 Claims, 3 Drawing Sheets

METHOD AND SYSTEM TO MASK OCCUPANT SOUNDS IN A RIDE SHARING ENVIRONMENT

INTRODUCTION

Autonomous vehicle ridesharing systems make it easy for people to get from place to place in an environmentally friendly manner, at reduced travel costs, and without the stresses of vehicle operation. However, ridesharing systems also force multiple strangers to occupy a restricted and small vehicle cabin during their commutes. This situation brings its own burdens and annoyances for rideshare consumers. For instance, when one person is talking on their smart device all other vehicle occupants will be able to hear at least part of the conversation. Thus, there is no privacy for the person on the phone while everyone else has to deal with the distraction they've created. It is therefore desirable to provide a system and method that can create privacy for people talking on their smart devices while they are commuting in a rideshare environment. Moreover, other desirable features and characteristics of the present invention will become apparent from the subsequent detailed description of the invention and the appended claims, taken in conjunction with the accompanying drawings and this background of the invention.

SUMMARY

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a method of sound masking, the method including: receiving, via a processor, a privacy request from a user; generating, via the processor, a masking sound configured to mask speech of the user in response to the privacy request; and providing, via the processor, the masking sound as an audio output through an audio system. Other embodiments of this aspect include corresponding computer systems, apparatus, and computer programs recorded on one or more computer storage devices, each configured to perform the actions of the methods.

Implementations may include one or more of the following features. The method further including: recognizing, via the processor, a call is being made on a mobile computing device; and prompting, via the processor, the user to provide the privacy request via a user interface installed in a vehicle interior in response to the call being made on the mobile computing device. The method further including: recognizing, via the processor, the call has ended; discontinuing, via the processor, the masking sound as the audio output; and providing, via the processor, a notification configured to notify the user the masking sound has been discontinued. The method further including retrieving, via the processor, one or more privacy preferences of the user from a remote entity. The method where the audio system is installed in an interior of a vehicle. The method where the privacy request is directed to a vehicle interior passenger zone associated with the user. The method where the privacy request is provided by a mobile computing device of the user. The method where the masking sound is configured to distort or cancel the speech of the user. Implementations of the described techniques may include hardware, a method or process, or computer software on a computer-accessible medium.

One general aspect includes a system to detect occupants within a vehicle interior, the system including: a memory configured to include one or more executable instructions and a processor configured to execute the executable instructions, where the executable instructions enable the processor to complete the following steps: receiving a privacy request from a user; generating a masking sound configured to mask the speech of the user in response to the privacy request; and providing the masking sound as an audio output through an audio system. Other embodiments of this aspect include corresponding computer systems, apparatus, and computer programs recorded on one or more computer storage devices, each configured to perform the actions of the methods.

Implementations may include one or more of the following features. The system where the executable instructions enable the processor to carryout the additional steps of: recognizing a call is being made on a mobile computing device. The system may also include prompting the user to provide the privacy request via a user interface installed in a vehicle interior in response to recognizing the call is being made. The system where the executable instructions enable the processor to carryout the additional steps of: recognizing the call has ended. The system may also include discontinuing the masking sound as the audio output; and providing a notification configured to notify the user the masking sound has been discontinued. The system where the executable instructions enable the processor to carryout the additional step of: retrieving one or more privacy preferences of the user from a remote entity. The system where the audio system is installed in an interior of a vehicle. The system where the privacy request is directed to a vehicle interior passenger zone associated with the user. The system where the privacy request is provided by a mobile computing device of the user. The system where the masking sound is configured to distort or cancel the speech of the user. Implementations of the described techniques may include hardware, a method or process, or computer software on a computer-accessible medium.

One general aspect includes a non-transitory and machine-readable medium having stored thereon executable instructions adapted to prompt a user for information upon being in proximity to a vehicle, which when provided to a processor and executed thereby, causes the processor to carry out the following steps: receiving a privacy request from a user. The non-transitory also includes generating a masking sound configured to mask the speech of the user in response to the privacy request. The non-transitory also includes providing the masking sound as an audio output through an audio system. Other embodiments of this aspect include corresponding computer systems, apparatus, and computer programs recorded on one or more computer storage devices, each configured to perform the actions of the methods.

Implementations may include one or more of the following features. The non-transitory and machine-readable memory which further causes the processor to carryout the steps of: recognizing a call is being made on a mobile computing device. The non-transitory may also include prompting the user to provide the privacy request via a user interface installed in a vehicle interior in response to recognizing the call is being made. The non-transitory and machine-readable memory which further causes the processor to carryout the steps of: recognizing the call has ended. The non-transitory may also include discontinuing the masking sound as the audio output. The non-transitory may also include providing a notification configured to notify the user the masking sound has been discontinued. Implementations of the described techniques may include hardware, a method or process, or computer software on a computer-accessible medium.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The disclosed examples will hereinafter be described in conjunction with the following drawing figures, wherein like numerals denote like elements, and wherein.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
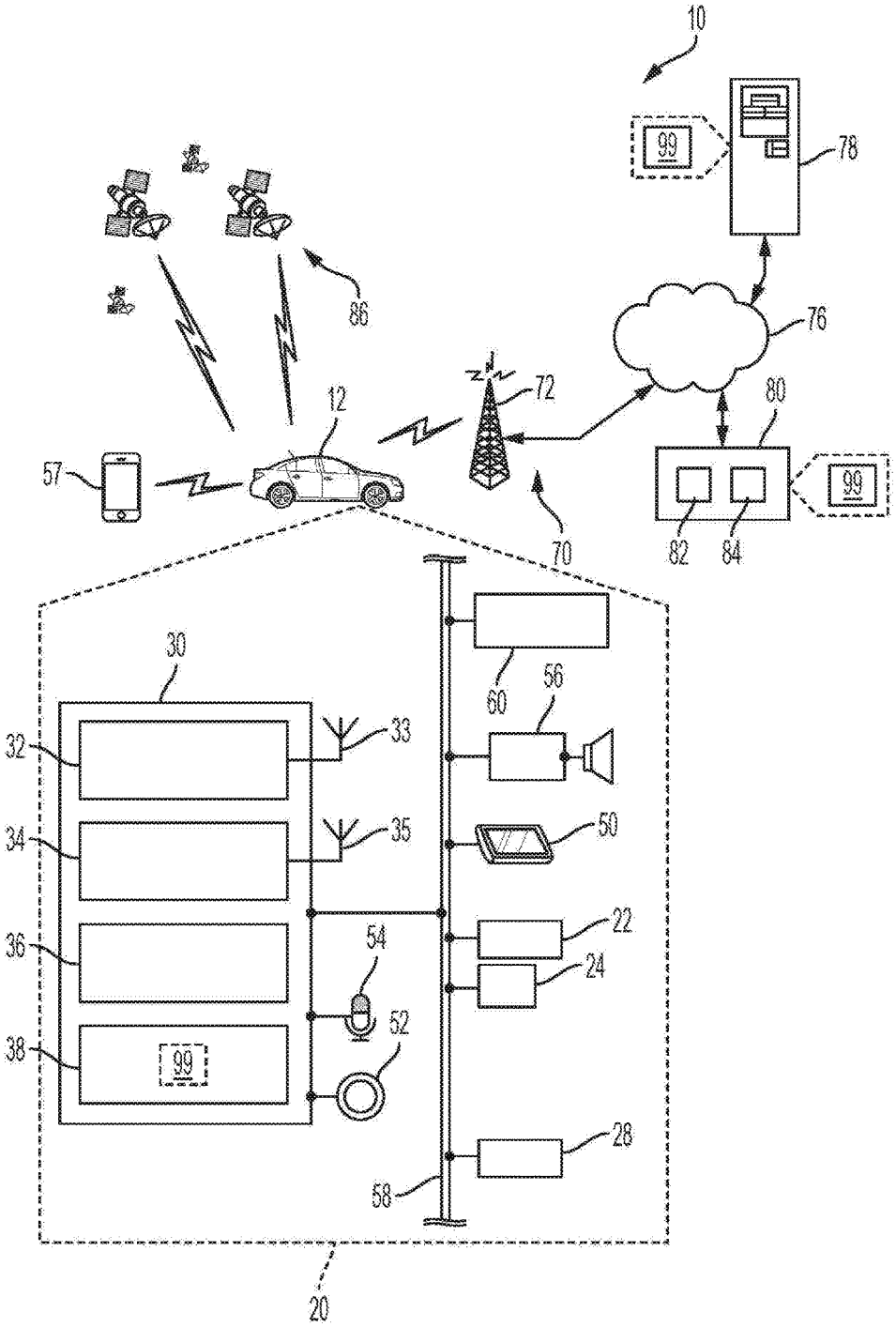
FIG. 1 is a block diagram depicting an exemplary embodiment of system capable of utilizing the system and method disclosed herein.

With reference to FIG. 1, there is shown an operating environment that comprises a communications system 10 and that can be used to implement the method disclosed herein. Communications system 10 generally includes a vehicle 12 that includes vehicle electronics 20, one or more wireless carrier systems 70, a land communications network 76, a computer or server 78, a vehicle backend services facility 80, and a constellation of global navigation satellite system (GNSS) satellites 86. It should be understood that the disclosed method can be used with any number of different systems and is not specifically limited to the operating environment shown here. Thus, the following paragraphs simply provide a brief overview of one such communications system 10; however, other systems not shown here could employ the disclosed method as well.

Vehicle 12 is depicted in the illustrated embodiment as a passenger car, but it should be appreciated that any other vehicle including motorcycles, trucks, sports utility vehicles (SUVs), recreational vehicles (RVs), marine vessels, aircraft including unmanned aerial vehicles (UAVs), etc., can also be used. In certain embodiments, vehicle 12 may include a power train system with multiple generally known torque-generating devices including, for example, an engine. The engine may be an internal combustion engine that uses one or more cylinders to combust fuel, such as gasoline, in order to propel vehicle 12. The power train system may alternatively include numerous electric motors or traction motors that convert electrical energy into mechanical energy for propulsion of vehicle 12.

Some of the vehicle electronics 20 are shown generally, in FIG. 1 and includes a global navigation satellite system (GNSS) receiver 22, a body control module or unit (BCM) 24, other vehicle system modules (VSMs) 28, a telematics unit 30, vehicle-user interfaces 50-56, and onboard computer 60. Some or all of the different vehicle electronics may be connected for communication with each other via one or more communication busses, such as communications bus 58. The communications bus 58 provides the vehicle electronics with network connections using one or more network protocols and can use a serial data communication architecture. Examples of suitable network connections include a controller area network (CAN), a media oriented system transfer (MOST), a local interconnection network (LIN), a local area network (LAN), and other appropriate connections such as Ethernet or others that conform with known ISO, SAE, and IEEE standards and specifications, to name but a few. In other embodiments, a wireless communications network that uses short-range wireless communications (SRWC) to communicate with one or more VSMs of the vehicle can be used. In one embodiment, the vehicle 12 can use a combination of a hardwired communications bus 58 and SRWCs. The SRWCs can be carried out using the telematics unit 30, for example.

The vehicle 12 can include numerous vehicle system modules (VSMs) as part of vehicle electronics 20, such as the GNSS receiver 22, BCM 24, telematics unit 30 (vehicle communications system), vehicle-user interfaces 50-56, and onboard computer 60, as will be described in detail below. The vehicle 12 can also include other VSMs 28 in the form of electronic hardware components that are located throughout the vehicle and, which may receive input from one or more sensors and use the sensed input to perform diagnostic, monitoring, control, reporting, and/or other functions. Each of the VSMs 28 is hardwire connected by communications bus 58 to the other VSMs including the telematics unit 30. Moreover, each of the VSMs can include and/or be communicatively coupled to suitable hardware that enables intra-vehicle communications to be carried out over the communications bus 58; such hardware can include, for example, bus interface connectors and/or modems. One or more VSMs 28 may periodically or occasionally have their software or firmware updated and, in some embodiments, such vehicle updates may be over the air (OTA) updates that are received from computer 78 or remote facility 80 via land network 76 and telematics unit 30. As is appreciated by those skilled in the art, the above-mentioned VSMs are only examples of some of the modules that may be used in vehicle 12, as numerous others are also possible. It should also be appreciated that these VSMs can otherwise be known as electronic control units, or ECUs.

Global navigation satellite system (GNSS) receiver 22 receives radio signals from a constellation of GNSS satellites 86. The GNSS receiver 22 can be configured for use with various GNSS implementations, including global positioning system (GPS) for the United States, BeiDou Navigation Satellite System (BDS) for China, Global Navigation Satellite System (GLONASS) for Russia, Galileo for the European Union, and various other navigation satellite systems. For example, the GNSS receiver 22 may be a GPS receiver, which may receive GPS signals from a constellation of GPS satellites 86. And, in another example, GNSS receiver 22 can be a BDS receiver that receives a plurality of GNSS (or BDS) signals from a constellation of GNSS (or BDS) satellites 86. The GNSS received can determine a current vehicle location based on reception of a plurality of GNSS signals from the constellation of GNSS satellites 86. The vehicle location information can then be communicated to the telematics unit 30, or other VSMs, such as the onboard computer 60. In one embodiment (as shown in FIG. 1), the wireless communications module 30 and/or a telematics unit can be integrated with the GNSS receiver 22 so that, for example, the GNSS receiver 22 and the telematics unit 30 (or the wireless communications device) are directly connected to one another as opposed to being connected via communications bus 58. In other embodiments, the GNSS receiver 22 is a separate, standalone module or there may be a GNSS receiver 22 integrated into the telematics unit 30 in addition to a separate, standalone GNSS receiver connected to telematics unit 30 via communications bus 58.

Body control module (BCM) 24 can be used to control various VSMs 28 of the vehicle, as well as obtain information concerning the VSMs, including their present state or status, as well as sensor information. The BCM 24 is shown in the exemplary embodiment of FIG. 1 as being electrically coupled to the communication bus 58. In some embodiments, the BCM 24 may be integrated with or part of a center stack module (CSM) and/or integrated with telematics unit 30 or the onboard computer 60. Or, the BCM may be a separate device that is connected to other VSMs via bus 58. The BCM 24 can include a processor and/or memory, which can be similar to processor 36 and memory 38 of telematics unit 30, as discussed below. The BCM 24 may communicate with wireless device 30 and/or one or more vehicle system modules, such as an engine control module (ECM), audio system 56, or other VSMs 28; in some embodiments, the BCM 24 can communicate with these modules via the communications bus 58. Software stored in the memory and executable by the processor enables the BCM to direct one or more vehicle functions or operations including, for example, controlling central locking, power windows, power sun/moon roof, the vehicle's head lamps, the horn system, air conditioning operations, power mirrors, controlling the vehicle primary mover (e.g., engine, primary propulsion system), and/or controlling various other vehicle modules. In one embodiment, the BCM 24 can be used (at least in part) to detect a vehicle event, such as a power on state or a power off state or when the vehicle's air conditioning operations are turned ON or OFF (i.e., cooled air is being blown or is stopped being blown from the vents of the vehicle's Heating Ventilation and Air Conditioning (HVAC) system), based on one or more onboard vehicle sensor readings, as discussed more below.

Telematics unit 30 is capable of communicating data via SRWC through use of SRWC circuit 32 and/or via cellular network communications through use of a cellular chipset 34, as depicted in the illustrated embodiment. The telematics unit 30 can provide an interface between various VSMs of the vehicle 12 and one or more devices external to the vehicle 12, such as one or more networks or systems at remote facility 80. This enables the vehicle to communicate data or information with remote systems, such as remote facility 80.

In at least one embodiment, the telematics unit 30 can also function as a central vehicle computer that can be used to carry out various vehicle tasks. In such embodiments, the telematics unit 30 can be integrated with the onboard computer 60 such that the onboard computer 60 and the telematics unit 30 are a single module. Or, the telematics unit 30 can be a separate central computer for the vehicle 12 in addition to the onboard computer 60. Also, the wireless communications device can be incorporated with or a part of other VSMs, such as a center stack module (CSM), body control module (BCM) 24, an infotainment module, a head unit, a telematics unit, and/or a gateway module. In some embodiments, the telematics unit 30 is a standalone module, and can be implemented as an OEM-installed (embedded) or aftermarket device that is installed in the vehicle.

In the illustrated embodiment, telematics unit 30 includes, the SRWC circuit 32, the cellular chipset 34, a processor 36, memory 38, SRWC antenna 33, and antenna 35. The telematics unit 30 can be configured to communicate wirelessly according to one or more SRWC protocols such as any of the Wi-Fi™, WiMAX™, Wi-Fi™ Direct, other IEEE 802.11 protocols, ZigBee™ Bluetooth™, Bluetooth™ Low Energy (BLE), or near field communication (NFC). As used herein, Bluetooth™ refers to any of the Bluetooth™ technologies, such as Bluetooth Low Energy™ (BLE), Bluetooth™ 4.1, Bluetooth™ 4.2, Bluetooth™ 5.0, and other Bluetooth™ technologies that may be developed. As used herein, Wi-Fi™ or Wi-Fi™ technology refers to any of the Wi-Fi™ technologies, such as IEEE 802.11b/g/n/ac or any other IEEE 802.11 technology. And, in some embodiments, the telematics unit 30 can be configured to communicate using IEEE 802.11p such that the vehicle can carry out vehicle-to-vehicle (V2V) communications, or vehicle-to-infrastructure (V21) communications with infrastructure systems or devices, such as the remote facility 80. And, in other embodiments, other protocols can be used for V2V or V21 communications.

The SRWC circuitry 32 enables the telematics unit 30 to transmit and receive SRWC signals, such as BLE signals. The SRWC circuit can allow the telematics unit 30 to connect to another SRWC device (e.g., mobile computing device 57). Additionally, in some embodiments, the telematics unit 30 contains a cellular chipset 34 thereby allowing the device to communicate via one or more cellular protocols, such as those used by cellular carrier system 70, through antenna 35. In such a case, the telematics unit 30 is user equipment (UE) that can be used to carry out cellular communications via cellular carrier system 70.

Antenna 35 is used for communications and is generally known to be located throughout vehicle 12 at one or more locations external to the telematics unit 30. Using antenna 35, telematics unit 30 may enable the vehicle 12 to be in communication with one or more local or remote networks (e.g., one or more networks at remote facility 80 or computers 78) via packet-switched data communication. This packet switched data communication may be carried out through use of a non-vehicle wireless access point or cellular system that is connected to a land network via a router or modem. When used for packet-switched data communication such as TCP/IP, the communications device 30 can be configured with a static Internet Protocol (IP) address or can be set up to automatically receive an assigned IP address from another device on the network such as a router or from a network address server.

Packet-switched data communications may also be carried out via use of a cellular network that may be accessible by the telematics unit 30. Communications device 30 may, via cellular chipset 34, communicate data over wireless carrier system 70. In such a scenario, radio transmissions may be used to establish a communications channel, such as a voice channel and/or a data channel, with wireless carrier system 70 so that voice and/or data transmissions can be sent and received over the channel. Data can be sent either via a data connection, such as via packet data transmission over a data channel, or via a voice channel using techniques known in the art. For combined services that involve both voice communication and data communication, the system can utilize a single call over a voice channel and switch as needed between voice and data transmission over the voice channel, and this can be done using techniques known to those skilled in the art.

One of the networked devices that can communicate with the telematics unit 30 is a mobile computing device 57, such as a smart phone, personal laptop computer, smart wearable device, or tablet computer having two-way communication capabilities, a netbook computer, or any suitable combinations thereof. The mobile computing device 57 can include computer processing capability and memory (not shown) and a transceiver capable of communicating with wireless carrier system 70. Examples of the mobile computing device 57 include the iPhone™ manufactured by Apple, Inc., and the Droid™ manufactured by Motorola, Inc. as well as others. Mobile device 57 may moreover be used inside or outside of vehicle 12, and may be coupled to the vehicle by wire or wirelessly. When using a SRWC protocol (e.g., Bluetooth/Bluetooth Low Energy or Wi-Fi), mobile computing device 57 and telematics unit 30 may pair/link one with another when within a wireless range (e.g., prior to experiencing a disconnection from the wireless network). In order to pair, mobile computing device 57 and telematics unit 30 may act in a BEACON or DISCOVERABLE MODE having a general identification (ID); SRWC pairing is known to skilled artisans. The general identifier (ID) transmitted by mobile computing device 57 may include, e.g., the device's name, unique identifier (e.g., serial number), class, available services, and other suitable technical information. Mobile computing device 57 and telematics unit 30 may also pair via a non-beacon mode.

Processor 36 can be any type of device capable of processing electronic instructions including microprocessors, microcontrollers, host processors, controllers, vehicle communication processors, and application specific integrated circuits (ASICs). It can be a dedicated processor used only for communications device 30 or can be shared with other vehicle systems. Processor 36 executes various types of digitally-stored instructions, such as software or firmware programs stored in memory 38, which enable the telematics unit 30 to provide a wide variety of services. For instance, in one embodiment, the processor 36 can execute programs or process data to carry out at least a part of the method discussed herein. Memory 38 may include any suitable non-transitory, computer-readable medium; these include different types of RAM (random-access memory, including various types of dynamic RAM (DRAM) and static RAM (SRAM)), ROM (read-only memory), solid-state drives (SSDs) (including other solid-state storage such as solid state hybrid drives (SSHDs)), hard disk drives (HDDs), magnetic or optical disc drives, that stores some or all of the software needed to carry out the various external device functions discussed herein. In one embodiment, the telematics unit 30 also includes a modem for communicating information over the communications bus 58.

A sound masking module (SMM) 99 can be stored on memory 38. When activated, based on the soundwaves of a vehicle occupant's speech, the SMM 99 produces unique sound waves from the speakers of audio system 56. These sound waves result in distorting or cancelling the speech from the mouth of a vehicle occupant. The SMM 99 can be used, for example, to reduce the distance at which a speaking occupant's conversations can be heard and understood by others listening occupants within the vehicle cabin (i.e., reducing the distraction of the conversation). It should be understood that sound masking of this nature is known in the art and that other sound masking techniques may be used.

In one embodiment, SMM 99 may generate a cancellation sound that corresponds to an occupant's speech, which may be extracted from the vehicle cabin by microphone 54 or the microphone embedded in mobile computing device 57. This may be done by the SMM 99 receiving the occupant's speech and generating an out-of-phase sound wave that substantially negates the sound waves of the speech (e.g., 180 degrees out of phase). Moreover, these out-of-phase sound waves are then output through selected speakers of audio system 56 to cancel out the occupant's speech. As follows, when the cancellation sound is output by audio system 56, the surrounding listening occupants will not be able to hear the voice of the speaking occupant and they will not be able to fully understand what is being said.

In an alternative embodiment, SMM 99 may generate a disturbance sound that corresponds to an occupant's speech, which may be extracted from the vehicle cabin by microphone 54 or the microphone embedded in mobile computing device 57. This may be done by modulation of a predetermined sound wave (sine waves derived from the occupant's voice signal), for example, by making the sine waves have white or pink noise. Moreover, once this sound wave has been sufficiently modulated, other sounds of similar formats may be generated (e.g., in a delayed interval by 5-10 ms from the actual voice signals) and added to the modulated sound wave to generate a disturbance sound. As follows, when the disturbance sound is output by selected speakers of audio system 56 (speakers surrounding the passenger zone of the speaking occupant), the surrounding listening occupants will only be able to hear the disturbance sound when the speaking occupant speaks and they will not be able to understand the meaning of the voice signal.

Vehicle electronics 20 also includes a number of vehicle-user interfaces that provide vehicle occupants with a means of providing and/or receiving information, including visual display 50, pushbutton(s) 52, microphone 54, and audio system 56. As used herein, the term "vehicle-user interface" broadly includes any suitable form of electronic device, including both hardware and software components, which is located on the vehicle and enables a vehicle user to communicate with or through a component of the vehicle. The pushbutton(s) 52 allow manual user input into the communications device 30 to provide other data, response, and/or control input. Audio system 56 includes one or more speakers located throughout the vehicle's cabin, which provides audio output to a vehicle occupant and can be a part of the primary vehicle audio system. According to one embodiment, audio system 56 is operatively coupled to both vehicle bus 58 and an entertainment bus (not shown) and can provide AM, FM and satellite radio, CD, DVD, and other multimedia functionality. This functionality can be provided in conjunction with or independent of an infotainment module. Microphone 54 provides audio input to the telematics unit 30 to enable the driver or other occupant to provide voice commands and/or carry out hands-free calling via the wireless carrier system 70. For this purpose, it can be connected to an on-board automated voice processing unit utilizing human-machine interface (HMI) technology known in the art. Visual display or touch screen 50 is preferably a graphics display and can be used to provide a multitude of input and output functions. Display 50 can be a touch screen on the instrument panel, a heads-up display reflected off of the windshield, a video projector that projects images onto the windshield from the vehicle cabin ceiling, or some other display. Various other vehicle-user interfaces can also be utilized, as the interfaces of FIG. 1 are only an example of one particular implementation.

Wireless carrier system 70 may be any suitable cellular telephone system. Carrier system 70 is shown as including a cellular tower 72; however, the carrier system 70 may include one or more of the following components (e.g., depending on the cellular technology): cellular towers, base transceiver stations, mobile switching centers, base station controllers, evolved nodes (e.g., eNodeBs), mobility management entities (MMEs), serving and PGN gateways, etc., as well as any other networking components that may be needed to connect wireless carrier system 70 with the land network 76 or to connect the wireless carrier system with user equipment (UEs, e.g., which can include telematics equipment in vehicle 12). Carrier system 70 can implement any suitable communications technology, including GSM/GPRS technology, CDMA or CDMA2000 technology, LTE technology, etc. In general, wireless carrier systems 70, their components, the arrangement of their components, the interaction between the components, etc. is generally known in the art.

Apart from using wireless carrier system 70, a different wireless carrier system in the form of satellite communication can be used to provide uni-directional or bi-directional communication with a vehicle. This can be done using one or more communication satellites (not shown) and an uplink transmitting station (not shown). Uni-directional communication can be, for example, satellite radio services, wherein programming content (news, music, etc.) is received by the uplink transmitting station, packaged for upload, and then sent to the satellite, which broadcasts the programming to subscribers. Bi-directional communication can be, for example, satellite telephony services using the one or more communication satellites to relay telephone communications between the vehicle 12 and the uplink transmitting station. If used, this satellite telephony can be utilized either in addition to or in lieu of wireless carrier system 70.

Land network 76 may be a conventional land-based telecommunications network that is connected to one or more landline telephones and connects wireless carrier system 70 to remote facility 80. For example, land network 76 may include a public switched telephone network (PSTN) such as that used to provide hardwired telephony, packet-switched data communications, and the Internet infrastructure. One or more segments of land network 76 could be implemented through the use of a standard wired network, a fiber or other optical network, a cable network, power lines, other wireless networks such as wireless local area networks (WLANs), networks providing broadband wireless access (BWA), or any combination thereof.

The computers 78 (only one shown) can be used for one or more purposes, such as for providing backend vehicle services to a plurality of vehicles (such as vehicle 12) and/or for providing other vehicle-related services. The computers 78 can be some of a number of computers accessible via a private or public network such as the Internet. Other such accessible computers 78 can be, for example: a service center computer where diagnostic information and other vehicle data can be uploaded from the vehicle; a client computer used by the vehicle owner or other subscriber for various purposes, such as accessing and/or receiving data communicated from the vehicle, as well as setting up and/or configuring subscriber preferences or controlling vehicle functions; or a vehicle telemetry data server that receives and stores data from a plurality of vehicles.

Vehicle backend services facility 80 is a remote facility, meaning that it is located at a physical location that is located remotely from the vehicle 12. The vehicle backend services facility 80 (or "remote facility 80" for short) may be designed to provide the vehicle electronics 20 with a number of different system back-end functions through use of one or more electronic servers 82 or live advisors. The vehicle backend services facility 80 includes vehicle backend services servers 82 and databases 84, which may be stored on a plurality of memory devices. Remote facility 80 may receive and transmit data via a modem connected to land network 76. Data transmissions may also be conducted by wireless systems, such as IEEE 802.11x, GPRS, and the like. Those skilled in the art will appreciate that, although only one remote facility 80 and one computer 78 are depicted in the illustrated embodiment, numerous remote facilities 80 and/or computers 78 may be used.

Servers 82 can be computers or other computing devices that include at least one processor and memory. The processors can be any type of device capable of processing electronic instructions including microprocessors, microcontrollers, host processors, controllers, vehicle communication processors, and application specific integrated circuits (ASICs). The processors can be dedicated processors used only for servers 82 or can be shared with other systems. The at least one processor can execute various types of digitally stored instructions, such as software or firmware, which enable the servers 82 to provide a wide variety of services. For network communications (e.g., intra-network communications, inter-network communications including Internet connections), the servers can include one or more network interface cards (NICs) (including, for example, wireless NICs (WNICs)) that can be used to transport data to and from the computers. These NICs can allow the one or more servers 82 to connect with one another, databases 84, or other networking devices, including routers, modems, and/or switches. In one particular embodiment, the NICs (including WNICs) of servers 82 may allow SRWC connections to be established and/or may include Ethernet (IEEE 802.3) ports to which Ethernet cables may be connected to that can provide for a data connection between two or more devices. Remote facility 80 can include a number of routers, modems, switches, or other network devices that can be used to provide networking capabilities, such as connecting with land network 76 and/or cellular carrier system 70.

Databases 84 can be stored on a plurality of memory, such as a powered temporary memory or any suitable non-transitory, computer-readable medium; these include different types of RAM (random-access memory, including various types of dynamic RAM (DRAM) and static RAM (SRAM)), ROM (read-only memory), solid-state drives (SSDs) (including other solid-state storage such as solid state hybrid drives (SSHDs)), hard disk drives (HDDs), magnetic or optical disc drives, that stores some or all of the software needed to carry out the various external device functions discussed herein. One or more databases 84 at the remote facility 80 can store various information and can include a vehicle operation database that stores information regarding the operation of various vehicles (e.g., vehicle telemetry or sensor data). For example, databases 84 can store SMM 99.

Method

The method or parts thereof can be implemented in a computer program product (e.g., a BCM 24, server 82, computers 78, telematics unit 30, etc.) embodied in a computer readable medium and including instructions usable by one or more processors of one or more computers of one or more systems to cause the system(s) to implement one or more of the method steps. The computer program product may include one or more software programs comprised of program instructions in source code, object code, executable code or other formats; one or more firmware programs; or hardware description language (HDL) files; and any program related data. The data may include data structures, look-up tables, or data in any other suitable format. The program instructions may include program modules, routines, programs, objects, components, and/or the like. The computer program can be executed on one computer or on multiple computers in communication with one another.

The program(s) can be embodied on computer readable media, which can be non-transitory and can include one or more storage devices, articles of manufacture, or the like. Exemplary computer readable media include computer system memory, e.g. RAM (random access memory), ROM (read only memory); semiconductor memory, e.g. EPROM (erasable, programmable ROM), EEPROM (electrically erasable, programmable ROM), flash memory; magnetic or optical disks or tapes; and/or the like. The computer readable medium may also include computer to computer connections, for example, when data is transferred or provided over a network or another communications connection (either wired, wireless, or a combination thereof). Any combination (s) of the above examples is also included within the scope of the computer-readable media. It is therefore to be understood that the method can be at least partially performed by any electronic articles and/or devices capable of carrying out instructions corresponding to one or more steps of the disclosed method.

Figure 2:
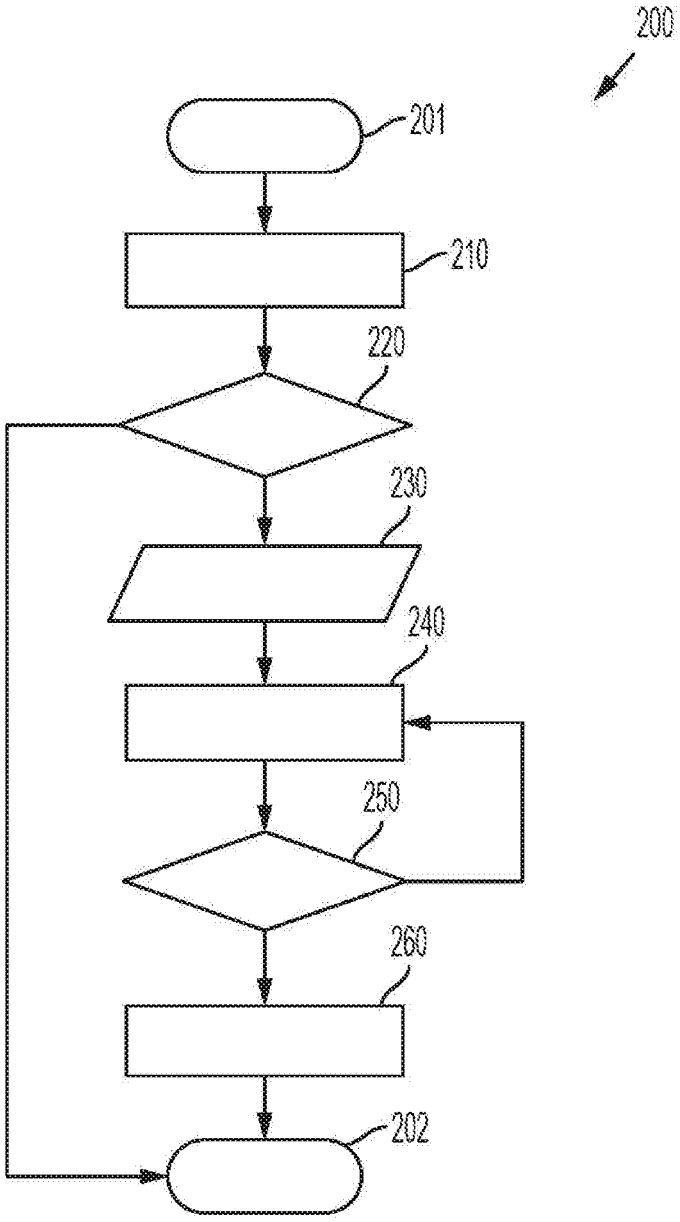
FIG. 2 is a flowchart of an exemplary process for masking occupant sound in a vehicle.

Turning now to FIG. 2, there is shown an embodiment of a method 200 to mask the speech sound coming from an occupant of a vehicle in a rideshare setting. One or more aspects of the speech sound masking method 200 may be completed through telematics unit 30 which may include one or more executable instructions incorporated into memory device 38 and carried out by electronic processing device 36. One or more ancillary aspects of method 200 may also be completed by audio system 56, SMM 99, mobile computing device 57, remote entity 80 (e.g., via server 82), or computers 78. Skilled artisans will moreover see that telematics unit 30, remote entity 80, computers 78, and mobile computing device 57 may be remotely located from each other.

Method 200 is supported by telematics unit 30 being configured to communicate with remote entity 80, computers 78, and mobile computing device 57. This configuration may be made by a vehicle manufacturer at or around the time of the telematics unit's assembly or after-market (e.g., via vehicle download using the afore-described communication system 10 or at a time of vehicle service, just to name a couple of examples). Method 200 is further supported by preconfiguring remote entity 80, computers 78, and mobile computing device 57 to receive communications from telematics unit 30.

Figure 3:
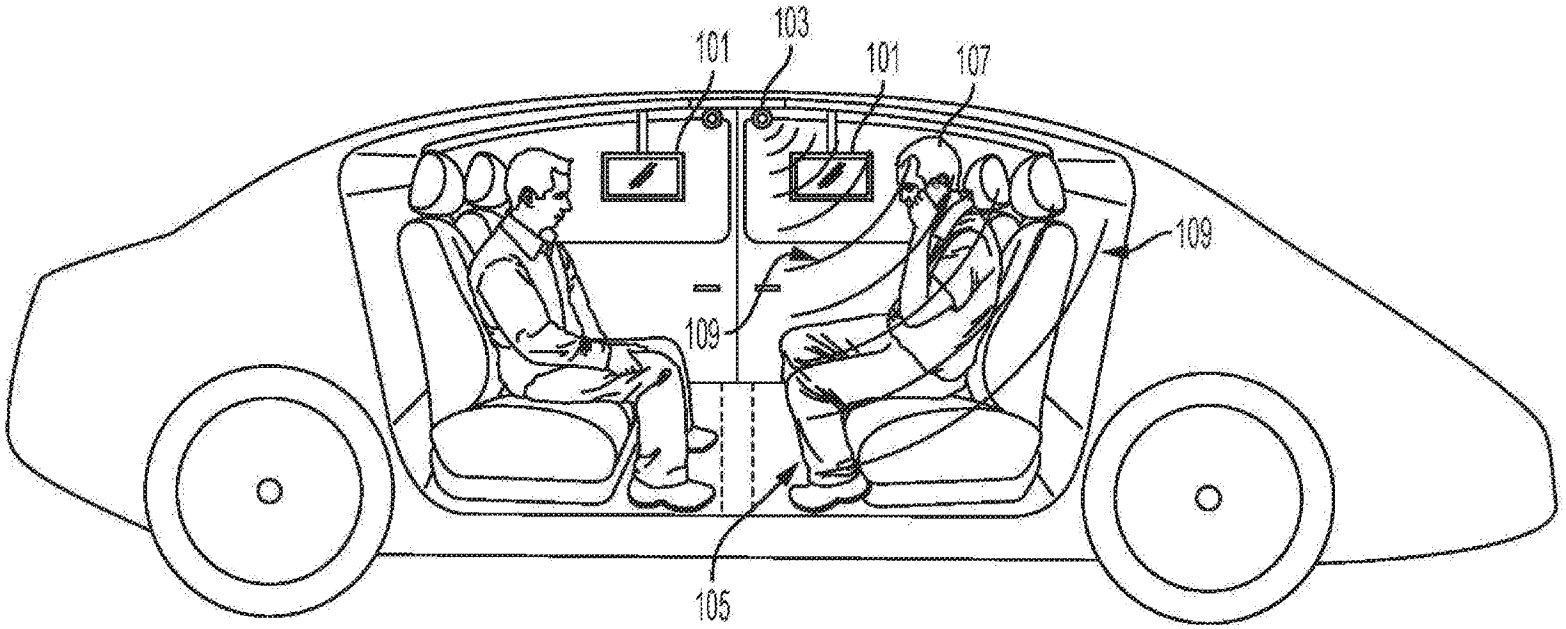
FIG. 3 depicts an application of an exemplary aspect of the process of FIG. 2 in accordance with one or more exemplary embodiments.

Method 200 begins at 201 in which multiple vehicle occupants are traveling together in vehicle 12. As such, vehicle 12 is part of a rideshare system and may be autonomous (as shown in FIG. 3). Moreover, at the beginning 201, mobile computing device 57, and telematics unit 30 have paired with each other.

In step 210, the mobile computing device 57 of one of the vehicle occupants (i.e., the user) will either receive a call (e.g., a phone call or request to join a teleconference) or make a call. In step 220, in one or more embodiments, in recognition of the call, telematics unit 30 may retrieve the privacy preferences of a user from databases 84. As follows, some time prior to entering the vehicle, the user may provide their rideshare privacy preferences to mobile computing device 57 via a user interface. Mobile computing device 57 will also transmit these privacy preferences to remote entity 80, to be stored in the databases 84 (so as to be associated with the mobile device's general identifier (ID), for example).

Moreover, in this step, based on the user's privacy settings (e.g., when the user indicates that they want privacy while using their phone within the rideshare vehicle cabin), telematics unit 30 will generate a privacy prompt on the user's personalized user interface device 101 (FIG. 3; e.g., a smart tablet or some other human machine interface connected to telematics unit 30), which is installed in their passenger zone of the vehicle 12. As such, the privacy prompt will ask the user that they will confirm they want privacy during their call, in accordance with their preset privacy settings. Alternatively, in one or more embodiments, for example, when the user and/or mobile computing device 57 has not previously provided privacy settings to databases 84, upon recognizing the call is being made, the telematics unit 30 will automatically generate a privacy prompt on the user's personalized user interface 101. In yet other alternative embodiments, the telematics unit 30 may generate a privacy prompt on the user interface of the user's mobile computing device 57, which may or may not be dependent on the privacy preferences previously provided to databases 84. If the user indicates they would like privacy via the privacy prompt, method 200 will move to step 230; otherwise, method 200 will move to completion 202.

In step 230, telematics unit 30 will receive the privacy request from the user via the user interface device 101 or mobile computing device 57. Upon receiving the privacy request from the user, the telematics unit 30 will activate the speakers of audio system 56 in the user's passenger zone (i.e., by selecting speakers that surround the seat of the user). It should be understood that the interior of vehicle 12 may be separated into two (2), four (4), or more passenger zones, depending on the number of vehicle occupants, and each passenger zone will encompass the seat and surrounding floor space associated with that specific zone.

In step 240, as can be seen with additional reference to FIG. 3, telematics unit 30 will enable SMM 99 to diffuse the soundwaves of the user's speech. In this way the SMM 99 will receive the voice sound waves of the user (e.g., via microphone 54 or through mobile computing device 57) and produce a masking sound that is output through the speaker (s) 103 associated with the passenger zone 105 of the user 107. Moreover, the soundwaves 109 of this masking sound will either cancel or distort the user's voice (as discussed above). In step 250, telematics unit 30 will monitor the phone call and determine whether the call has ended. When telematics unit 30 recognizes the call has ended, method 200 will move to step 260; otherwise, method 200 will return to step 240. In step 260, telematics unit 30 will cause SMM 99 to discontinue generating the masking sound through audio system 56. Telematics unit 30 will also turn off the speakers associated with the passenger zone (so they will not continue to draw power from the vehicle's battery). Moreover, telematics unit 30 will produce a notification through the user interface device 101 which notifies the user the sound masking processes are complete and that others in the vehicle's cabin can again hear what the user is saying. After step 260, method 200 will move to completion 202.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

None of the elements recited in the claims are intended to be a means-plus-function element within the meaning of 35 U.S.C. § 112(f) unless an element is expressly recited using the phrase "means for," or in the case of a method claim using the phrases "operation for" or "step for" in the claim.

What is claimed is:

1. A method of sound masking, the method comprising:

recognizing, via a processor, a call is being made on a mobile computing device;

prompting, via the processor, a user to provide a privacy request via a user interface installed in a vehicle interior in response to the call being made on the mobile computing device;

receiving, via the processor, the privacy request from the user;

generating, via the processor, a masking sound configured to mask speech of the user in response to the privacy request;

providing, via the processor, the masking sound as an audio output through an audio system;

recognizing, via the processor, the call has ended;

discontinuing, via the processor, the masking sound as the audio output; and providing, via the processor, a notification configured to notify the user the masking sound has been discontinued.

2. The method of claim 1, further comprising retrieving, via the processor, one or more privacy preferences of the user from a remote entity.

3. The method of claim 1, wherein the audio system is installed in an interior of a vehicle.

4. The method of claim 1, wherein the privacy request is directed to a vehicle interior passenger zone associated with the user.

5. The method of claim 1, wherein the privacy request is provided by a mobile computing device of the user.

6. The method of claim 1, wherein the masking sound is configured to distort or cancel the speech of the user.

7. A system to detect occupants within a vehicle interior, the system comprising:

a memory configured to comprise one or more executable instructions and a processor configured to execute the executable instructions, wherein the executable instructions enable the processor to complete the following steps:

recognizing a call is being made on a mobile computing device;

prompting a user to provide a privacy request via a user interface installed in a vehicle interior in response to recognizing the call is being made;

receiving the privacy request from the user;

generating a masking sound configured to mask the speech of the user in response to the privacy request;

providing the masking sound as an audio output through an audio system;

recognizing the call has ended;

discontinuing the masking sound as the audio output; and providing a notification configured to notify the user the masking sound has been discontinued.

8. The system of claim 7, wherein the executable instructions enable the processor to carryout the additional step of:

retrieving one or more privacy preferences of the user from a remote entity.

9. The system of claim 7, wherein the audio system is installed in an interior of a vehicle.

10. The system of claim 7, wherein the privacy request is directed to a vehicle interior passenger zone associated with the user.

11. The system of claim 7, wherein the privacy request is provided by a mobile computing device of the user.

12. The system of claim 7, wherein the masking sound is configured to distort or cancel the speech of the user.

13. A non-transitory and machine-readable medium having stored thereon executable instructions adapted to prompt a user for information upon being in proximity to a vehicle, which when provided to a processor and executed thereby, causes the processor to carry out the following steps:

recognizing a call is being made on a mobile computing device;

prompting a user to provide a privacy request via a user interface installed in a vehicle interior in response to recognizing the call is being made;

receiving the privacy request from the user;

generating a masking sound configured to mask the speech of the user in response to the privacy request;

providing the masking sound as an audio output through an audio system;

recognizing the call has ended;

discontinuing the masking sound as the audio output; and providing a notification configured to notify the user the masking sound has been discontinued.

14. The non-transitory and machine-readable memory of claim 13, which further causes the processor to carryout the steps of:

retrieving one or more privacy preferences of the user from a remote entity.

* * * * *